US006386968B2

(12) United States Patent
Mehlman et al.

(10) Patent No.: US 6,386,968 B2
(45) **Date of Patent: *May 14, 2002**

(54) METHOD AND APPARATUS FOR PERFORMING CONFINEMENT BY THERMAL STRATIFICATION

(75) Inventors: Guillaume Mehlman; François Meline, both of Paris (FR)

(73) Assignee: Compagnie Generale des Matieres, Velizy-Villacoublay (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/167,013

(22) Filed: Oct. 6, 1998

(30) Foreign Application Priority Data

Oct. 24, 1997 (FR) ..... 97 13338

(51) Int. Cl.[7] ..... G21F 5/00
(52) U.S. Cl. ..... 454/190
(58) Field of Search ..... 376/308, 305; 23/230 R; 165/96; 126/427; 454/190, 191; 250/506.1

(56) References Cited

U.S. PATENT DOCUMENTS 4,390,008 A * 6/1983 Andrews ..... 126/427
4,576,613 A 3/1986 Miline ..... 55/1
5,078,574 A 1/1992 Olsen ..... 415/182.1
5,934,992 A * 8/1999 Sohier et al. ..... 454/190

FOREIGN PATENT DOCUMENTS

DE 2 305 101 8/1974
EP 0 099 818 1/1992

* cited by examiner

*Primary Examiner*—Paul Dzierzynski
*Assistant Examiner*—Johnnie L Smith, II
(74) *Attorney, Agent, or Firm*—Cohen, Pontani, Lieberman & Pavane

(57) ABSTRACT

The present invention relates to a method of confining pollution generated in the top volume and/or in the bottom volume of an enclosure filled with a fluid, i.e. either a gas, which is in general air, or a liquid, which is in general water, the method confining the pollution by thermal stratification. In said method the mean temperature of said top volume is maintained higher than the mean temperature of said bottom volume by an amount that is sufficient to ensure that said two volumes are separated by a turbulent intermediate zone of narrow width, referred to as the "mixing zone", within which a steep temperature gradient is maintained; said intermediate zone constituting a virtual confinement barrier in a horizontal plane. The present invention also relates to apparatus associated with the method.

27 Claims, 3 Drawing Sheets

METHOD AND APPARATUS FOR PERFORMING CONFINEMENT BY THERMAL STRATIFICATION

FIELD OF THE INVENTION

The present invention relates to a method and apparatus for performing confinement. It relates more precisely to a method of confining pollution generated in the top volume and/or in the bottom volume of an enclosure filled with a fluid, and to apparatus associated with said method. Said method is industrial and it is original in that it is based on the natural phenomenon of thermal stratification. When it is implemented, it can surprisingly guarantee effective confinement in various contexts, and in particular in the most unfavorable context in which a hot pollution source is disposed at the bottom of an enclosure whose top portion is to be protected from said pollution source. The Applicant has developed the method and apparatus of the invention specially for the context of vitrifying fission products in the nuclear industry, with a view to protecting equipment of the hoist type disposed at the top of the vitrification cell from pollution given off by the melting pot and by the calciner. However, said method and apparatus of the invention, which method and apparatus are described in detail below, are in no way limited to this context.

BACKGROUND OF THE INVENTION

In the prior art, the phenomenon of fluid stratification is well known.

In Liquids

Gravity stratification is commonly observed in non-miscible liquids of different densities. It is very stable and requires high energy to cause the two phases to be mixed (emulsion). In the absence of an emulsion, the relatively small area of the interface per unit volume constitutes an effective barrier against the transfer of a solute or of particles in suspension from one phase to the other.

In Gases

A similar phenomenon can be observed, if the two phases are gases of different densities situated in an enclosure of large volume in which the ambient environment is disturbed little.

In this case, the stratification phenomenon is much less stable and the interface is less clearly defined than for the interface between liquid phases. The interface is replaced with a "mixing zone" due to Brownian motion and turbulent diffusion in which the mean concentration of one phase in the other varies continuously with a steep gradient when going up the vertical axis.

With reference more particularly to thermal stratification, it is known that differences in density exist in the same fluid because of differences in temperature; the fluid can then behave as two distinct phases, namely a cold phase and a hot phase. The two phases are not very miscible if the volumes involved are large, and they can thus present the same stratification phenomena as fluids of distinct compositions. This natural phenomenon of thermal stratification explains the following:

- the ocean currents;
- the meteorological phenomenon of temperature inversion and its effects on atmospheric pollution; and
- the temperature profile (as a function of depth) of water in a mountain lake.

In the context of the present invention, it has been observed, surprisingly, that it is possible to control said natural phenomenon of thermal stratification so as to use it to create genuine confinement barriers artificially in horizontal planes both in liquids and in gases. As a person skilled in the art can easily understand, it is far from obvious that such control can be achieved. Indeed, it would seem unlikely to be possible for it to be achieved, in particular in a gaseous atmosphere which is very sensitive to convection currents and to turbulence. Preconceived opinion was therefore strongly unfavorable to basing an industrial method of confinement on the natural phenomenon of thermal stratification.

Known methods of confinement, implemented currently and while the invention was being developed, in particular to protect equipment from a polluting atmosphere charged with particles, are of the following types:

- close protection with the use of a covering;
- protection by curtains of air;
- protection under laminar flow; and
- protection based on thermophoresis.

After becoming acquainted with the present invention, the person skilled in the art can appreciate the advantages that the invention offers in various contexts over the above-mentioned prior art techniques. At this stage of the description, it is worth emphasizing that the method of the invention is effective, and that the accessory equipment required to implement it is compact.

OBJECTS AND SUMMARY OF THE INVENTION

It is proposed to describe below the two aspects of the invention, namely the method and the apparatus, in a general manner in a first part, and in a more detailed manner in a second part, with reference to a particular implementation.

The invention thus provides firstly a method of confining pollution generated in the top volume and/or in the bottom volume of an enclosure filled with a fluid, i.e. either a gas, which is in general air, or a liquid, which is in general water, the method confining the pollution by thermal stratification: the mean temperature of said top volume is maintained higher than the mean temperature of said bottom volume by an amount that is sufficient to ensure that said two volumes are separated by a turbulent intermediate zone of narrow width, referred to as the "mixing zone", within which a steep temperature gradient is maintained; said intermediate zone constituting a virtual confinement barrier acting as a virtual partition in a horizontal plane.

Said method consists in creating artificially a confinement barrier between the top volume and the bottom volume of the enclosure by maintaining a sufficiently large temperature difference between said top and bottom volumes (the temperature of said top volume being obviously maintained higher than the temperature of said bottom volume). Said temperature difference must guarantee a sufficiently large density difference between the hot fluid in the top volume and the cold fluid in the bottom volume. Said density difference must be such that the effects of vertical forces, directed downwards for the cold fluid and upwards for the hot fluid (said forces, which are due Archimedes' thrust, being applied to the various volumes of the two phases, and tending to separate them by stratification) prevail over the effects of inertia forces due to the rate at which said volumes penetrate into the mixing zone. The inertia forces are due to the random speeds in the turbulence of the ambient environment, and they are responsible for diffusion mixing and for heat exchange between phases. Thus, by means of the invention, the enclosure is artificially subdivided into two distinct enclosures.

As specified above, the method of the invention may be implemented in an enclosure filled with gas (the enclosure is then more readily referred to as a "cell" or a "room"), or in an enclosure filled with liquid (such as a "pool"). In general, only one fluid, i.e. either a gas or a liquid, is involved. When the fluid is a gas it consists, in general, of air; when it is a liquid, it consists, in general, of water. Other gases, such as nitrogen, for example, and indeed other liquids are in no way excluded from the ambit of the invention. Similarly, the invention does not exclude the possibility of two different types of gas or of two different types of liquid being present in the enclosure. However, in such an event, the densities of the two fluids involved must be compatible with implementation of the method.

The method of the invention confines the two volumes of the enclosure, namely the top volume and the bottom volume, relative to each other, and any pollution being generated in one of said volumes is kept out of the other volume, or if pollution is being generated in both of said volumes, then each of said volumes is protected from the pollution being generated in the other volume.

The pollution may be of various types. Its source may, for example, consist of a mechanical source of dust, in particular radioactive dust (such as a sawing station, a shearing station, or a welding station, in general located at the bottom of an enclosure; such a station may equally well be positioned at the top of an enclosure, in particular when work is to be done on the top of equipment such as a rocket), or else the source of the pollution may consist of (optionally hot) feedstock emitting vapor charged with particles (such as the melting pot and the calciner that are disposed at the bottom of a cell for vitrifying fission products).

Such a pollution source may be cold or hot, and it may be disposed at the top of and/or at the bottom of the enclosure. All cases are possible, the least favorable case being when a hot pollution source is disposed at the bottom of the enclosure. The pollution given off by such a source tends to pollute the top zone naturally by convection. The method of the invention can be implemented effectively in the various other cases, and it is also effective in this difficult context which is particularly difficult when operating in a gaseous atmosphere.

Suitable means are used to maintain the top and bottom volumes of the enclosure at temperatures such that thermal stratification is established in stable manner. In an advantageous variant of the method of the invention, the top volume and the bottom volume are swept independently with fluid injected at respective suitable temperatures; the fluid injected into the top volume being extracted therefrom immediately above the top interface of the mixing zone (confinement barrier), and the fluid injected into the bottom volume being extracted therefrom immediately below the bottom interface of said mixing zone; said fluids being either identical or different, and being injected into the respective volumes under conditions that minimize the vertical component of the speed of the turbulence that is generated.

This advantageous variant may be implemented either:

with a gas (or even two gases, as mentioned above), such as air, that is blown hot into the top volume and that is blown cold into the bottom volume; or with a liquid (or even two liquids, as mentioned above), such as water, that is injected hot into the top volume and that is injected cold into the bottom volume.

In any event, to obtain optimum effectiveness, which means that the generated confinement barrier must be stabilized, it is necessary to ensure that the hot and cold fluids are injected "smoothly". Naturally, said fluids are advantageously also extracted smoothly, but the disturbances generated on extraction are less harmful. The disturbances generated by the injection thus need to be minimized. For this purpose, the vertical component of the speed of the turbulence generated is minimized. Advantageously, and for the same purpose, it is sought to ensure that speeds are uniformly distributed at the outlet sections of the injection means, and said injection means are disposed as far as possible from the mixing zone constituting the confinement barrier. It can be understood that, conversely, the means for extracting the injected fluids are situated as close as possible to said mixing zone.

In an advantageous variant implementation of the invention, the hot fluid sweeping the top volume of the enclosure is recycled, at least in part.

In the method of the invention, a confinement barrier is thus created in a horizontal plane by maintaining a sufficiently large temperature difference between the bottom portion (cold zone) and the top portion (hot zone) of the enclosure. The temperature difference may be generated by any means. As mentioned above, it advantageously results from said bottom and top portions being swept with fluid(s) at suitable temperatures.

The present invention also provides apparatus suitable for implementing the above-described method of confinement. In characteristic manner, said apparatus for confining pollution generated in the top volume and/or in the bottom volume of an enclosure filled with a fluid, i.e. either a gas, which is in general air, or a liquid, which is general water, comprises:

temperature-maintaining means for maintaining the mean temperature of said top volume greater than the mean temperature of said bottom volume thereby creating a virtual confinement barrier in a horizontal plane between said top volume and said bottom volume, said virtual confinement barrier being constituted by a narrow, turbulent intermediate zone referred to as the "mixing zone", within which a steep temperature gradient is maintained;

and advantageously means for thermally-insulating at least some of the walls of said top volume.

The person skilled in the art understands that several variants are possible for said means for maintaining the top and bottom volumes of the enclosure at the suitable temperatures, and that, in any event, it is advantageous to insulate said top volume thermally. It is advantageous firstly to reduce heat exchange and secondly to avoid too large a temperature difference between said walls of said top volume and the ambient atmosphere. Such a large temperature difference would give rise to convection currents and to harmful turbulence.

In the context of the advantageous variant of the method of invention in which the top volume and the bottom volume are swept with fluid maintained at respective suitable temperatures, it is recommended for the temperature-maintaining means for maintaining the suitable temperatures in each of said volumes to comprise fluid delivery apparatus and fluid extraction apparatus suitably disposed in each of said volumes, and suitable for ensuring that each of said volumes is swept. Said delivery apparatus is of shape and size optimized to reduce the vertical speed component of the turbulence generated. Naturally, said delivery apparatus is connected upstream to means suitable for feeding in the fluid at the desired temperature, and said extraction apparatus is connected downstream to suitable means for sucking out said fluid once it has swept the volume in question (top volume or bottom volume).

It is recommended for the extraction apparatus for extracting the hot fluid from the top volume (more precisely from the bottom of said top volume), and for the extraction apparatus for extracting the cold fluid from the bottom volume (more precisely from the top of said bottom volume) to consist of narrow slots distributed uniformly on respective common levels and facing one another along the entire length of two opposite vertical walls of the enclosure. Naturally, care is taken to ensure that the vertical walls in which the slots are provided are not structurally weakened thereby. Each slot is actually subdivided into a plurality of slot elements. When the enclosure is a rectangular block, the person skilled in the art can understand that said extraction slots are advantageously disposed along the longitudinal (horizontal) axis of said enclosure.

It is recommended for said delivery apparatus for delivering the hot fluid into the top volume (more precisely into the top of said top volume) and/or for said delivery apparatus for delivering the cold fluid into the bottom volume (more precisely into the bottom of said bottom volume) to consist of a) a respective horizontal surface ensuring that said fluid is distributed continuously; or b) at least two narrow slots distributed uniformly and parallel over the entire length of a horizontal wall (floor and/or ceiling) of the enclosure; or c) two respective series of slots of narrow width and of small height distributed uniformly in staggered manner over the entire length of two opposite vertical walls of the enclosure; said slots starting at or in the vicinities of the horizontal wall(s) (ceiling and/or floor) in contact with said vertical walls.

In variant a), the floor (or false floor) and/or the ceiling (or false ceiling) of the enclosure is perforated over at least part of its surface, thereby constituting a wall for diffusing the injected fluid.

In variant b), longitudinal slots (in general at least two such slots) are provided to ensure that sweeping is effective. Said slots may be organized in the same manner in a false ceiling or in a false floor.

In variant c), two series of slots are provided in the bottom and/or the top of vertical walls of the enclosure. These slots are distributed in staggered manner (the two series are advantageously uniformly offset) so as to minimize the turbulence generated on injection. Advantageously, the slots that are provided in the bottom volume of the enclosure are not at floor (or false floor) level, but rather they are slightly above floor (or false floor) level. This avoids stirring up any dust that has settled on said floor (or false floor).

The apparatus of the invention may use the same type or different types of fluid delivery apparatus in the top and bottom volumes of the enclosure. In an advantageous variant, in the volume(s) in which the pollution is generated, namely the top volume and/or the bottom volume, the fluid delivery apparatus is of above type c). This type of apparatus is particularly optimized for minimizing the vertical speed component of the turbulence generated on injection.

Advantageously, this type of apparatus provided in the polluted top or bottom volume is associated with apparatus of above type b) in the corresponding non-polluted bottom or top volume (assuming that the pollution is generated in one of said volumes only).

The means of the apparatus of the invention that are provided for ensuring that the top volume is swept with a hot fluid advantageously include means for recycling said hot fluid at least in part.

Similarly, the means of the apparatus of the invention that are provided for ensuring that the bottom volume is swept with a cold fluid are advantageously fed with a fluid at ambient temperature or with fluid cooled upstream, advantageously by means of a heat pump that uses the heat energy taken from said fluid to raise the temperature of the fluid fed to the hot fluid delivery apparatus.

In the context of the invention, it is thus possible by various means (thermally insulting, recycling, providing heat exchangers) to optimize the energy efficiency of the method.

In a variant embodiment, suitable in particular for confining pollution given off by a possibly hot pollution source disposed at the bottom of an enclosure filled with a gas, which is in general air, said apparatus of the invention comprises:

in its bottom volume, delivery apparatus of above type c) for delivering a cold gas, in general air;

in its top volume, delivery apparatus of above type b) for delivering a hot gas, in general air; and in each of its top and bottom volumes, extraction apparatus of the slot type, as described above, for extracting the injected gas, in general air.

This variant is illustrated below.

BRIEF DESCRIPTION OF THE DRAWINGS

More precisely, the invention is described below with reference to the accompanying figures in a particular context which constitutes an example.

Said particular context is the above-mentioned context of a cell for vitrifying fission products, which cell contains a contaminating heat source at its bottom and is equipped with an overhead travelling-crane at its top. The following description can be generalized to any context of this type, in which a contaminating heat source is disposed at the bottom and equipment that requires periodic maintenance that needs to be protected is disposed at the top.

In the accompanying figures:

FIG. 1 (prior art) is a diagrammatic section view of such a cell;

FIG. 2 is a like view of such a cell in which the method of confinement of the invention (confinement by thermal stratification) is implemented;

FIG. 3 shows a profile of the temperatures inside the cell shown in FIG. 2;

FIG. 4 is a perspective view of the FIG. 2 cell as equipped with confinement apparatus of the invention;

FIG. 5 is a section view on V of FIG. 4; and

FIG. 6 is an enlarged view of a portion of FIG. 5.

MORE DETAILED DESCRIPTION

Figure 2:
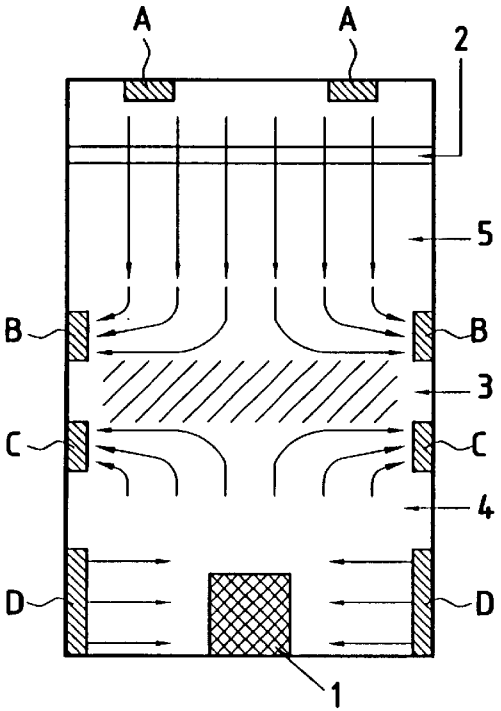
Figure 1:
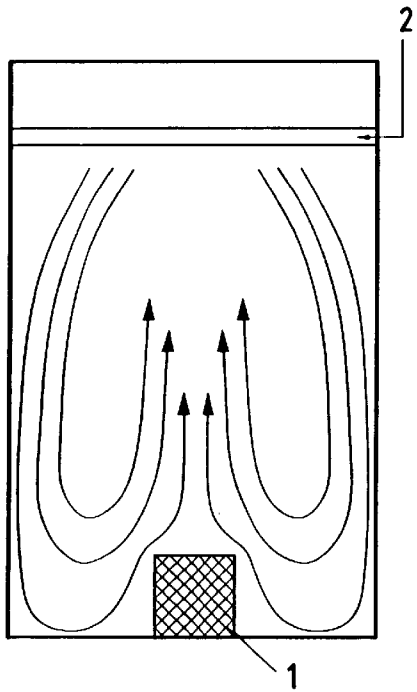
FIG.1 ( PRIOR ART )

As shown in FIGS. 1 and 2, the cell contains the pollution source 1 (melting pot and calciner, represented diagrammatically), and the overhead travelling-crane 2 to be protected from said pollution source 1. Said cell is filled with air.

The technical problem facing the inventors was to limit significantly the contamination of hoists in such cells. The air heated and contaminated by the melting pot and the calciner 1 rises in the cell as it would in a chimney, and insofar as the air is charged with radioactive particles, it contaminates the crane 2 at the top of the cell, thereby making any maintenance operations performed on this equipment much more complex. Experience has shown that the availability of hoists present in cells containing hot pollution sources is related directly to the degree to which they are contaminated.

In the context of the example, and of the entire research conducted by the Applicant, and whose results are given further on in the present text (table of the example), the cell had the following dimensions:

| | |
|---|---|
| Length | 12.0 m |
| Width | 3.6 m |
| Height under the tracks supporting the crane | 7.5 m |
| Total height | 9.0 m |

In the prior art (FIG. 1), a ventilation system is installed for protecting said crane 2. Air is fed into the top of the cell (above the melting pot) and is extracted at the bottom of the opposite wall. Said air is injected at a temperature of 28° C. at a flow rate of 4,300 $Nm^3$ per hour ($Nm^3/h$).

According to the invention (FIG. 2), a confinement barrier 3 is created in a horizontal plane by maintaining a temperature difference that is large enough between the bottom portion (cold zone) 4 and the top portion (hot zone) 5 of the cell.

Said temperature difference is maintained by a suitable ventilation system and must be such that the resultant of the gravitational forces that are applied to a volume of cold air penetrating into the hot zone 5 is greater than the inertial forces that are applied thereto, thereby causing the volume of cold air to fall back towards the bottom of the cell until it reaches equilibrium and thus preventing it from contaminating the crane 2 in the top portion 5 of the cell.

Figure 3:
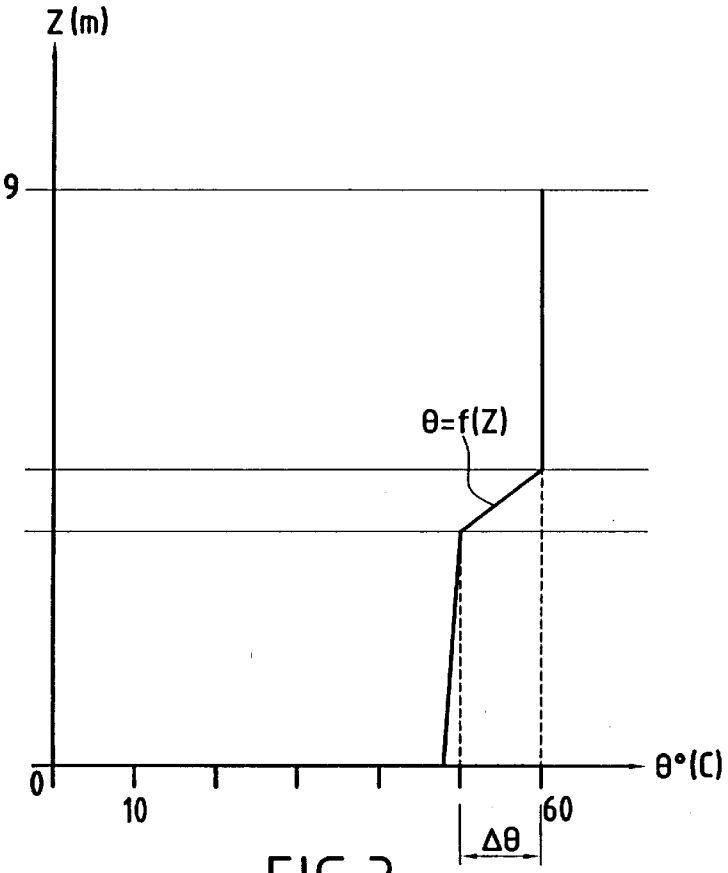

The confinement barrier 3 is a mixing zone in whose volume the vertical temperature gradient is much steeper than the temperature gradients in either of the two volumes 4 and 5 lying outside of this zone 3 (see FIG. 3). In general, the thickness of said mixing zone must be less than 15% of the height of the cell. Said thickness is defined as a function of the geometrical characteristics of the cell, such as:

the height of the cell;

the height of the volume generated by the displacement of the crane; and the height occupied by the equipment included in the polluted zone.

For any given level of disturbance of the zones (namely the hot zone and the cold zone), the larger the temperature difference between the zones, the smaller said thickness.

The bottom volume 4 and the top volume 5 are swept by means of ventilation (the fluids involved are hot air at 60° C. and cold air at 28° C., see example below). The following can be specified concerning the ventilation:

1) General Principle

The ventilation is designed as if it were to guarantee the desired rate of air renewal in two distinct and superposed cells (4 and 5) separated by a physical volume whose thickness is the thickness of the mixing zone 3. The two virtual cells (or zones) are fed with a flow of air that has undergone the usual treatment undergone by air for ventilating reprocessing units.

The intake openings A and D are disposed such that, they produce, respectively in zone 5 and in zone 4, a continuous vertical low-speed flow (a few centimeters per second (cm/s)) whose random component needs to be as small as possible. The flow in the bottom (cold) zone 4 is directed upwards, and the flow in the top (hot) zone 5 is directed downwards.

The extraction slots B and C are situated on either side of the mixing zone 3:

the hot-air extraction slots B are situated just above the top interface of the said mixing zone 3; and the cold-air extraction slots C are situated just below the bottom interface of said zone 3.

The extraction slots B and C stabilize the level of said mixing zone 3.

This stabilization requires the ratios of the intake flow rates to the extraction flow rates of the hot air circuit and of the cold air circuit to be controlled sufficiently accurately. The simplest solution to implement for this purpose is to recycle the hot air. This also offers the advantage of saving heat energy and of reducing the size of the heater units.

2) The Physical Characteristics of the Air that Determine the Dimensioning of the Ventilation a) Air in the Hot Zone 5

Feed Flow Rate

Since zone 5 does not contain any pollution source, it is necessary:

on the one hand, for the flow speed (vertically downwards) through a horizontal cross-section in the vicinity of the top plane of the mixing zone 3 to be higher than the speeds of the Brownian motion and of the turbulent diffusion of the polluting particles that have penetrated into said mixing zone 3; and on the other hand, for the flow rate of hot air to be high enough to compensate for losses by convection with the walls.

Thermally insulating the side walls of the top zone 5, thereby reducing the heat exchange and the stray convection currents, contributes to the stability of the mixing zone 3.

Temperature

The temperature in the top zone 5 must be as high as possible, and it is limited only by the constraint that the motors of the hoist must be cooled.

b) Air in the Cold Zone 4

Feed Flow Rate

The flow rate of the air fed into the bottom volume 4 is a function of the intensity and of the type of the pollution sources, and mainly of the total power given off by the heat sources that they contain; it being necessary for the resulting rise in the mean temperature of the air to be compensated by the flow rate of cold air.

In each case, the maximum allowable value for the flow rate is determined by the constraint that it is necessary to limit the thickness of the mixing layer 3 (and thus the speed of penetration and the upward speed of the flow of air through a horizontal cross-section).

Temperature

Since low temperatures are a factor favorable to reducing the thickness of the mixing layer 3 and to increasing its stability (provided that it remains positive), there is no lower limit to the temperature of the air in the bottom zone. However, for reasons of simplicity and to limit investment, air at ambient temperature is generally used. The temperature taken into account for dimensioning purposes must then be the temperature corresponding to the meteorological maximum recorded on the site during a reference period of sufficient length.

Level of Turbulence

The turbulence is greater than in the hot zone 5 because of the presence of the heat sources and because of the way the intake openings D are disposed, and it is characterized by the maximum value of the root mean square of the random speed at the interface with the mixing zone 3, which is the parameter determining the height of said zone 3.

Concerning the apparatus used to implement the ventilation, the following can be specified.

1) Feed and Design of the Ventilation Openings

In order for stratification to be effective, it is essential for the intake flow rates through the ventilation openings A, D and for the extraction flow rates through the extraction slots B, C to be distributed uniformly.

The feed ducts to the intake openings A, D and the extraction ducts from the extraction slots B, C must be designed as a function of this constraint (fan blading, ducts of varying section, etc.). Therefore, and because of increase in overall size that could otherwise occur, studying duct dimensions is an essential element in the design of the apparatus, it being necessary for this work to precede the work on the civil engineering of the cell.

The cell may be designed with thermally-insulating double inner walls (e.g. made of expanded glass); the gap of about 0.4 m between these walls and the structural walls of the cell then being available for the ducts and apparatus for distributing the intake air.

In addition, it is necessary for the speeds at the delivery sections of the intake openings A, D to be uniformly distributed. This may be obtained by lining the delivery orifice with two or three layers of perforated sheet metal having transparency of about 20%, the layers being a few millimeters apart.

In general, the intake openings A, D, which are "inductive" (i.e. they induce internal circulation movements) must be as far as possible from the mixing zone 3, whereas the extraction slots B, C, whose induction effect on the surrounding environment is very limited in space, may be situated closer to the mixing zone 3 for which they define and stabilize the limits on the vertical walls of the cell.

Figure 4:
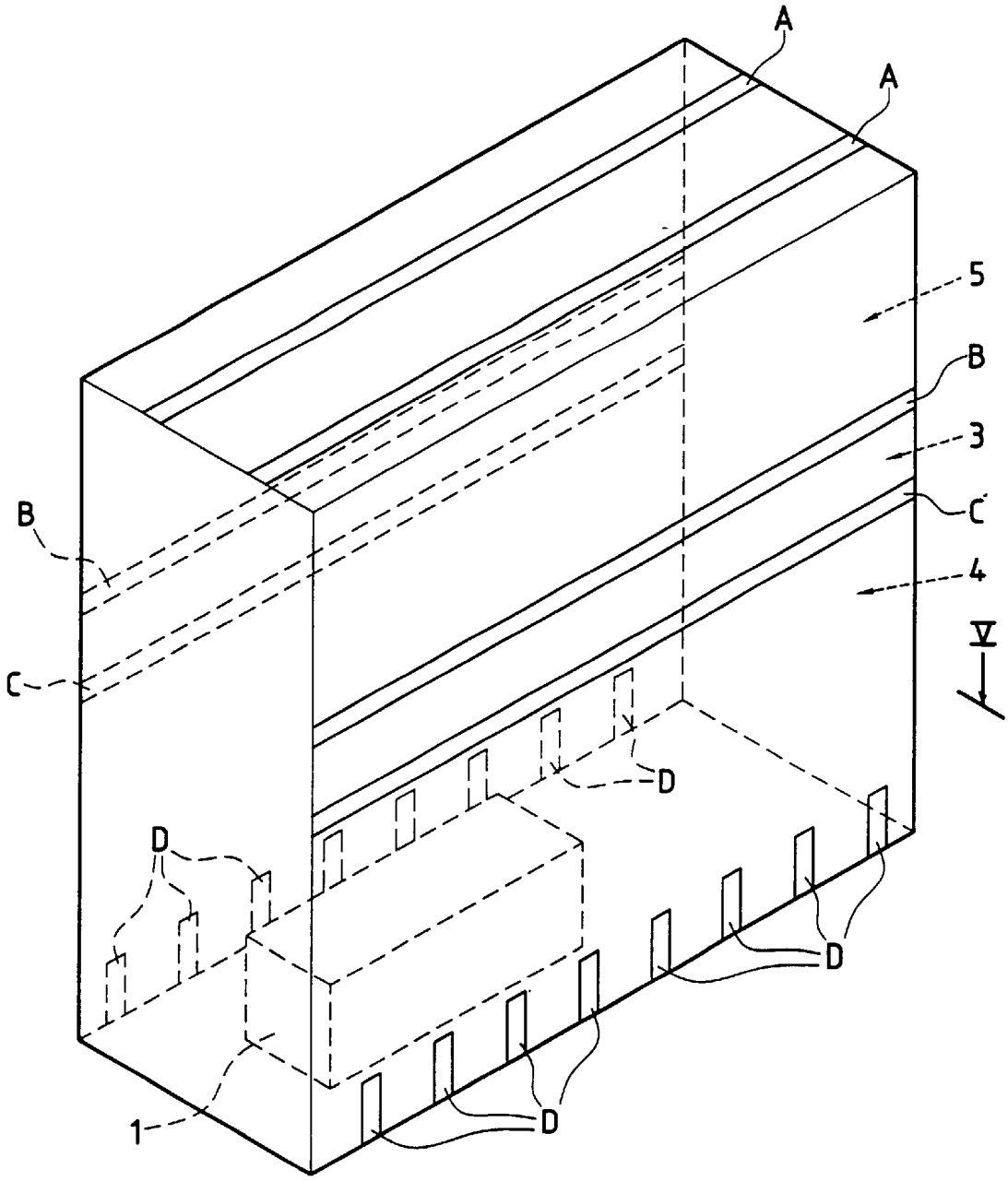

2) Hot Air Intake Openings (Slots) (see FIGS. 2 and 4)

a) General Configuration

They must be disposed such that they make it possible to distribute the hot air flow rate across the horizontal sections in the vicinity of the mixing zone 3, so that the flow is as close as possible to laminar flow.

To satisfy these conditions (while taking account of the way in which the hoist is fixed), the intake openings may be disposed in the form of narrow slots that are parallel to the longitudinal axis of the cell and that are almost continuous.

Their delivery speed, which determines their minimum section as a function of the desired flow rate, must be such that the maximum speeds of impact on the elements making up the crane 2 are not more than 0.4 meters per second (m/s). This avoids any generation of turbulence which would be harmful to the stability of the mixing zone 3.

b) Hot Air Flow Rate

The hot air flow rate is chosen so as to guarantee a flow speed of about 0.04 m/s through the horizontal cross-sectional area of the top volume 5. In view of the intake speed and of the distribution chosen for the feed openings for feeding the top zone 5, the flow in the vicinity of the top plane of the mixing zone 3 can be considered to be a laminar flow in which turbulent diffusion is negligible, and, even for the finest polluting particles (which diffuse the fastest), the Brownian diffusion speed is much lower than 0.04 m/s.

3) Cold Air Intake Openings (Slots) (see FIGS. 2, 4, 5, and 6)

a) General Configuration

The cold air delivery openings D are disposed and shaped so as to make the concentration of polluted air and of hot air within the ambient environment in the bottom zone (cold zone) 4 as uniform as possible, while limiting the vertical components of the random speeds of the induced turbulence.

The narrow delivery openings D (in the form of vertical slots or "loopholes") are situated in the vicinity of the floor on the long sides of the cell, and are disposed in staggered manner.

Figure 6:
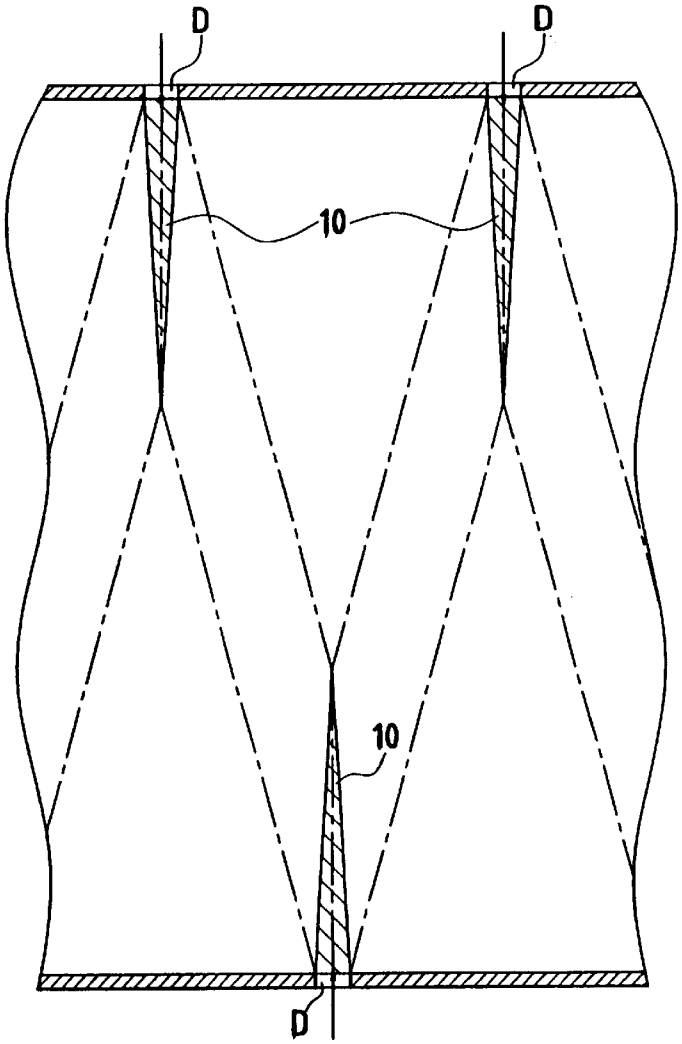

This layout produces interfitting jets 10 of air having vertical axial planes (see FIG. 6).

Figure 5:
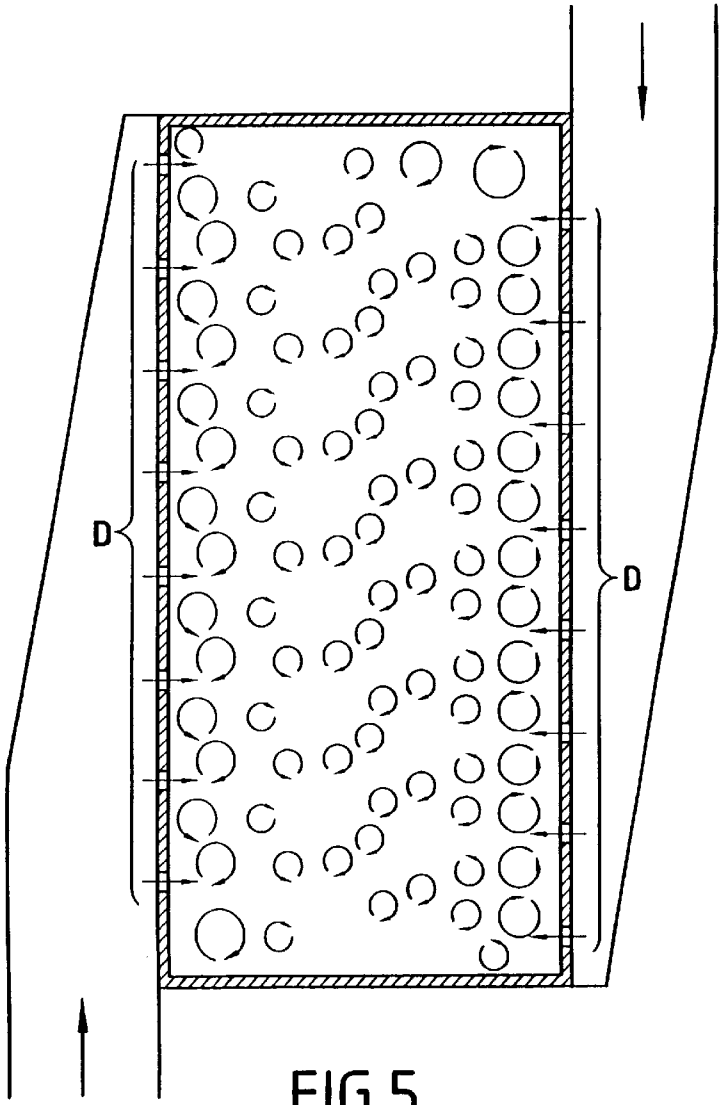

By a shear effect due to the opposite speeds, these plane-jets produce eddies whose speeds have small vertical components and which cause the currents output by the various sources to mix with the ambient environment (see FIG. 5).

It is observed that the eddies having horizontal axes and generating vertical random speeds are produced from an area that is very small (the area of a "loophole") compared with the area of the interface between jets 10. Furthermore, it can be seen that the speed differential between the top portions of the jets 10 and the almost immobile ambient environment in the cell is half as large as the speed differential between opposite jets, thereby generating horizontal currents that predominate considerably relative to the upwardly-directed vertical currents. For these two reasons, the vertical components of the random speeds are significantly attenuated, and the phenomena of penetration into the mixing layer are thus limited; in addition, this layout tends to brake, by dilution, the upward speed of the currents output by the heat sources, this being the most important factor in any possible penetration of the pollution into the protected zone 5.

b) Cold Air Flow Rate

The value of the mean upward speed of the air is chosen to be about 0.04 m/s in order to limit entrainment of polluting particles by the ventilation air from the bottom zone 4 to those particles whose "aerodynamic diameter" is smaller than 35 $\mu$m. The particles having a larger diameter tend to settle in the cell, they do not adhere to the walls, and they can be removed by vacuum cleaning.

This speed defines a flow rate that is a function of the horizontal cross-sectional area of the cell, and that must be high enough, in view of the feed temperature of the cold air and of the power of the heat sources 1, to maintain a sufficiently low temperature in the cold zone 4. In certain applications in which the mean heat power given off by the heat sources per unit volume of the cell is very high, a unit for cooling the feed air may then be necessary to limit its flow rate. In that particular case, the most rational solution may be to use a heat pump for raising the temperature of the hot air while lowering the temperature of the cold air.

4) Extraction Slots B, C (for Cold Air (C) and for Hot Air (B))

The cold air extraction slots C and the hot air extraction slots B are disposed in horizontal lines constituting slots that are almost continuous (gaps between the vertical sides of the suction openings as narrow as possible), the horizontal lines extending facing each other on the long sides.

The top level of the cold air extraction slots C defines the bottom plane of the mixing zone 3, while the bottom level of the hot air extraction slots B defines the top plane of said mixing zone 3. The top level of the hot air extraction slots B must be situated about 1 m below the bottom level of the volume in which the hoist moves. When the crane has a vehicle deck, the top level of the hot air extraction slots must be situated below the level of the deck of said crane.

With reference to FIG. 3, the following may be specified.

A shallow temperature gradient is observed in the bottom volume, because of the presence of the polluting heat source. The desired steep temperature gradient is observed in the mixing zone 3 which constitutes the (virtual) confinement barrier.

With reference to FIG. 4, it is specified that, for reasons of simplification, the crane 2 is not shown.

The method of the invention has been implemented in the vitrification cell whose dimensions are specified above, with the apparatus described above and shown diagrammatically in accompanying FIGS. 2, and 4 to 6. The following table gives the characteristics of said method and apparatus.

| Characteristics | Cold air | Hot air |
|---|---|---|
| Intake temperature | 28° C. | 60° |
| Intake flow rate | 5,300 $Nm^3/h$ | 5,100 $Nm^3/h$ |
| Zone temperature | 4 48° C. | 5 60° C. |
| Mass flow rate of air | 1.9 kg/s | 1.8 kg/s |
| Width of intake openings | D 0.19 m | A 0.18 m |
| Length of intake openings | D 0.81 m (to obtain vertical plane jets) | A 12.0 m = length of the cell |
| Horizontal distance between two intake openings | D 1.12 m | A as a function of the overall size of the crane |
| Total number of intake openings | D 16 (8 "loopholes" distributed in staggered manner in each of the long vertical faces of the cell) | A two parallel slots, in the ceiling of the cell |
| Orientation of the intake openings | D Vertical | A Horizontal |
| Positioning of the intake openings | D Bottom edges in the vicinities of the floor level of the cell | A Extending in the longer-length direction |
| Number of extraction slots | C 2 (1 slot in each long vertical face) | B 2 (1 slot in each long vertical face) |
| Orientation of the extraction slots | C Horizontal | B Horizontal |
| Positioning of the extraction slots | C 4.5 m above the floor of the cell, at the bottom limit of the mixing zone | B 5.8 m above the floor of the cell, at the top limit of the mixing zone |
| Width of the extraction slots | C 0.2 m | B 0.2 m |
| Length of the extraction slots | C = length of the cell = 12.0 m | B = length of the cell = 12.0 m |

What is claimed is:

1. A method of creating a virtual confinement barrier between a top portion and a bottom portion of a substantially vertically-disposed substantially closed volume that extends continuously and physically uninterruptedly between the top and bottom portions, each of the top and bottom portions containing a fluid intended to be substantially separately contained in a respective one of the top and bottom portions, said method comprising the steps of:

maintaining the fluid in the bottom portion at a first mean temperature; and maintaining the fluid in the top portion at a second mean temperature selectively greater than said first mean temperature to thereby define a temperature differential between the fluids in said top and bottom portions and a temperature gradient in an intermediate mixing zone of constricted width between said top and bottom portions within which said temperature differential and said temperature gradient creates turbulence in said mixing zone sufficient to prevent unintended intermixing fluid flow between said top and bottom portions and thereby define by said temperature differential a virtual confinement barrier substantially confining within each of the top and bottom portions the fluid contained in the respective top and bottom portions of the vertically-disposed volume.

2. The method according to claim 1, wherein said maintaining of the fluid in the bottom portion at the first mean temperature comprises:

injecting the fluid at the first mean temperature into the bottom portion in a manner so as to avoid by said fluid injection creation of turbulence in said mixing zone as a result of said fluid injection; and extracting the fluid at a location disposed between a location of said fluid injection in the bottom portion and said mixing zone.

3. The method according to claim 1, wherein said maintaining of the fluid in the top portion at the second mean temperature comprises:

injecting the fluid at the second mean temperature into the top portion in a manner so as to avoid by said fluid injection creation of turbulence in said mixing zone as a result of said fluid injection; and extracting the fluid at a location between a location of said fluid injection into the top portion and said mixing zone.

4. The method according to claim 3, wherein said maintaining of the fluid in the top portion at the second mean temperature comprises:

injecting the fluid at the second mean temperature into the top portion in a manner so as to avoid by said fluid injection creation of turbulence in said mixing zone as a result of said fluid injection; and extracting the fluid at a location between a location of said fluid injection into the top portion and said mixing zone.

5. The method according to claim 1, wherein the temperature differential is further selected to create a density difference between the fluids in the top and bottom portions that minimizes a vertical component of a speed of fluid turbulence in the top and bottom portions.

6. The method according to claim 1, further comprising the step of:

recycling at least some of the fluid in the top portion.

7. The method according to claim 1, wherein the fluid in the top and bottom portions comprises gas.

8. The method according to claim 7, wherein the gas comprises air.

9. The method according to claim 7, wherein said volume is bounded by an enclosure configured to confine in one of the top and bottom portions a pollutant generated by a pollution source.

10. The method according to claim 1, wherein the fluid in the top and bottom portions comprises liquid.

11. The method according to claim 10, wherein the liquid comprises water.

12. An apparatus for creating in a walled enclosure a virtual confinement barrier between a top portion and a bottom portion of a substantially vertically-disposed substantially closed volume of the enclosure that extends continuously and physically uninterruptedly between the top and bottom portions, each of the top and bottom portions containing a fluid intended to be substantially separately contained in a respective one of the top and bottom portions, said apparatus comprising:

a first temperature-maintaining means for maintaining the fluid in the bottom portion at a first mean temperature; and a second temperature-maintaining means for maintaining the fluid in the top portion at a second mean temperature selectively greater than said first mean temperature to thereby define a temperature differential between the fluids in said top and bottom portions and a temperature gradient in an intermediate mixing zone of constricted width between said top and bottom portions within which said temperature differential and said temperature gradient creates turbulence in said mixing zone sufficient to prevent unintended intermixing fluid flow between said top and bottom portions and thereby define by said temperature differential a virtual confinement barrier substantially confining within each of the top and bottom portions the fluid contained in the respective top and bottom portions of the vertically-disposed volume.

13. The apparatus in accordance with claim 12, wherein said first temperature-maintaining means comprises:

a first fluid injection means for injecting the fluid at the first mean temperature into said bottom portion in a manner so as to avoid by said fluid injection creation of turbulence in said mixing zone as a result of said fluid injection from said first fluid injection means; and a first fluid extraction means disposed at a location between said first fluid injection means and said mixing zone for extracting the injected fluid from said bottom portion.

14. The apparatus in accordance with claim 13, wherein said second temperature-maintaining means comprises:

a second fluid injection means for injecting the fluid at the second mean temperature into said top portion in a manner so as to avoid by said fluid injection creation of turbulence in said mixing zone as a result of said fluid injection from said second fluid injection means; and a second fluid extraction apparatus disposed at a location between said second fluid injection apparatus and said mixing zone for extracting the injected fluid from said bottom portion.

15. The apparatus according to claim 14, wherein the enclosure further comprises means for insulating walls of the enclosure at the top portion of the volume.

16. The apparatus according to claim 12 wherein said first and second temperature-maintaining means are configured so that the temperature differential creates a density difference between the fluids in said top and bottom portions that minimizes a vertical component of a speed of fluid turbulence in said top and bottom portions.

17. The apparatus according to claim 14, wherein said first and second fluid extraction means each comprise a slot disposed at a like vertical level on opposite walls of said enclosure.

18. The apparatus according to claim 14, wherein at least one of said first and second fluid injection means is disposed on a substantially horizontal wall surface of the respective bottom and top portion.

19. The apparatus according to claim 14, wherein at least one of said first and second fluid injection means comprises at least two slots distributed along a length of a horizontal wall of the enclosure.

20. The apparatus according to claim 14, wherein at least one of said first and second fluid injection means comprises two series of slots distributed in a staggered manner along a length of opposite vertically-oriented walls of the enclosure, said slots being proximate to an intersection of a horizontal wall and said vertical walls.

21. The apparatus according to claim 14, further comprising a recycling means configured to recycle at least some of the fluid in said top portion.

22. The apparatus according to claim 14, said first fluid injection means is fed with one of fluid at ambient temperature and cooled fluid.

23. The apparatus according to claim 22, further comprising a heat pump for drawing heat energy from fluid injected into said bottom portion for use in raising the mean temperature of the fluid injected into said top portion.

24. The apparatus according to claim 12, wherein the fluid in said top and bottom portions comprises a gas.

25. The apparatus according to claim 24, wherein the gas comprises air.

26. The apparatus according to claim 12, wherein the fluid in said top and bottom portions comprises a liquid.

27. The apparatus according to claim 26, wherein the liquid comprises water.

* * * * *